US006866102B2

(12) United States Patent
Boyce et al.

(10) Patent No.: US 6,866,102 B2
(45) Date of Patent: Mar. 15, 2005

(54) ELECTRICAL FIRE EXTINGUISHING SYSTEM

(76) Inventors: Lenuel Boyce, 4618 N. 31st Ave., Omaha, NE (US) 68111; Judith A. Lee, 14605 N. 84th St., Omaha, NE (US) 68122

( * ) Notice: Subject to any disclaimer, the term of this patent is extended or adjusted under 35 U.S.C. 154(b) by 0 days.

(21) Appl. No.: 10/424,371

(22) Filed: Apr. 28, 2003

(65) Prior Publication Data

US 2004/0216895 A1 Nov. 4, 2004

(51) Int. Cl.[7] ..... A62C 37/10
(52) U.S. Cl. ..... 169/61; 169/26
(58) Field of Search ..... 169/5, 19, 26–51, 169/56, 57, 59, 54, 58, 60, 61–70

(56) References Cited

U.S. PATENT DOCUMENTS 3,866,687 A * 2/1975 Banner ..... 169/61
4,711,307 A * 12/1987 Rosen ..... 169/57
4,893,680 A * 1/1990 Wittbrodt et al. ..... 169/60
4,984,637 A * 1/1991 Finnigan ..... 169/61
5,936,531 A * 8/1999 Powers ..... 340/628
6,029,751 A * 2/2000 Ford et al. ..... 169/60

* cited by examiner

*Primary Examiner*—David A. Scherbel
*Assistant Examiner*—Thach H. Bui
(74) *Attorney, Agent, or Firm*—Adam H. Jacobs

(57) ABSTRACT

An electrical fire suppression system for a structure having electrical fixtures includes a central computer system and a plurality of fire sensing devices distributed through the structure. A central fire suppression fluid tank is connected to fire suppression fluid pipes and a set of valves are mounted on the fire suppression fluid pipes to control fire suppression fluid flow therethrough, the valves being controlled by the central computer system. Each of the plurality of fire suppression fluid pipes extend into at least one of the electrical fixtures for transfer of fire suppression fluid directly thereto. Upon detection of fire, the fire sensing device signals the central computer system to determine the location of the fire and command the valves on the fire suppression fluid pipes to open to release fire suppression fluid therethrough for extinguishing the fire at the electrical fixture at which it started.

4 Claims, 3 Drawing Sheets

ELECTRICAL FIRE EXTINGUISHING SYSTEM

BACKGROUND OF THE INVENTION

1. Technical Field

The present invention relates to fire suppression systems for buildings and, more particularly, to an electrical fire extinguishing system for a structure which includes electrical outlets, devices, appliances and/or fixtures, the system including a central computer system, a plurality of fire sensors distributed through the structure, a central fire suppression fluid tank, a plurality of fire suppression fluid pipes connected to the tank, valves for controlling fluid flow through the fire suppression fluid pipes with each of the fire suppression fluid pipes extending into an associated electrical outlet, device, appliance or fixture, and the central computer system, fire sensing devices and valves cooperating such that upon one of the fire sensing devices detecting fire in the structure, the central computer system signals the appropriate valve to open to release fire suppression fluid into the electrical outlet, device, appliance or fixture with which the fire suppression fluid pipe is associated.

2. Description of the Prior Art

Fire suppression systems in buildings are well known and are used in a variety of circumstances. As a general rule, the fire suppression systems used in buildings consist of a system of water pipes which extend into each room and hallway of the building with sprinklers mounted in the ceilings of the rooms and hallways such that when a fire is detected, the sprinkler system engages and releases water through the sprinkler to douse any fires in the rooms where the fire was detected. While this type of system has been generally acceptable and has saved numerous lives, there is still the problem that many of the fires caused in modern buildings are not of the type which are easily extinguished by the application of water alone. There is therefore a need for an improved fire suppression system which is designed to extinguish fire types which are not easily extinguished by water alone.

There are several examples found in the prior art which disclose fire extinguishing systems which are intended to improve upon the standard sprinkler-type fire extinguisher. These include such devices as Powers, U.S. Pat. No. 5,936,531, Rosen, U.S. Pat. No. 4,711,307, and Livingston, U.S. Pat. No. 3,833,062. These devices, however, share one thing in common with the water sprinkler systems of the prior art and that is that they are designed to flood the entire room with fire suppression fluid to extinguish the fire, causing damage to all furnishings within the room. While this damage is generally considered an acceptable price to pay to put out the fire, it is considered so only because to date there have been presented no alternative solutions which do not cause damage to the building furnishings. There is therefore a need for an improved fire extinguishing system that will limit damage to furnishings while still extinguishing the fire.

With few exceptions, the prior art devices are not designed to stop the fire where the fire begins, such as in an electrical outlet or electrical fixture. Instead, the fire may become quite large before the fire extinguishing systems are engaged, which can result in large amounts of damage to room furnishings even if the fire is extinguished. There is therefore a need for a fire suppression system which operates on electrical outlets and electrical fixtures and will minimize fire damage to room furnishings.

Also, those prior art devices which do show fire extinguishing systems designed for use with electrical outlets are generally designed as individual units to be fitted into electrical outlets only. Thus there is no centralized system which will send fire extinguishing fluid to each of the other electrical fixtures, outlets, and other electrical devices which are integral to modern buildings. It is estimated that over fifty percent of all structure fires are electrical in nature, and, to the best of the inventor's knowledge, there are currently no examples found in the prior art which address and solve this problem. There is therefore a need for a centrally located fire suppression system for electrical devices which will quickly and efficiently extinguish electrical fires at their source.

Therefore, an object of the present invention is to provide an improved electrical fire extinguishing system.

Another object of the present invention is to provide an improved electrical fire extinguishing system which includes a central fire suppression fluid tank connected to each of the electrical fixtures, outlets and switches throughout the building by a series of fire suppression fluid pipes which transfer the fluid from the central tank to each of the electrical outlets depending on the fire condition thereof.

Another object of the present invention is to provide an improved electrical fire extinguishing system which includes a central computer system connected to a series of fire detection devices and which is operatively connected to several valves mounted on the fire suppression fluid pipes such that detection of a fire in a particular location permits the central computer system to engage the valve for that particular area and send fire suppression fluid to the fire location, thus preventing peripheral damage to room furnishings of the kind caused by engagement of sprinkler systems yet still extinguishing the fire.

Finally, an object of the present invention is to provide an improved electrical fire extinguishing system which may be quickly and easily be added to buildings during construction thereof and will greatly enhance the fire fighting capabilities of fire suppression systems currently used.

SUMMARY OF THE INVENTION

The present invention provides an electrical fire suppression system for a structure having electrical outlets, devices, appliances and fixtures, the system including a central computer system and a plurality of fire sensing devices distributed through the structure in information transmission connection with the central computer system. A central fire suppression fluid tank is connected to a plurality of fire suppression fluid pipes in fluid transmission connection with the central fire suppression fluid tank, and a set of valves are mounted on the plurality of fire suppression fluid pipes to control fire suppression fluid flow therethrough, the valves being controlled by the central computer system. Each of the plurality of fire suppression fluid pipes extends into at least one of the electrical outlets, devices, appliances and fixtures for transfer of fire suppression fluid directly to the electrical outlet, device, appliance and fixture thereby extinguishing electrically-caused fires at the source thereof. Finally, the central computer system, the plurality of fire sensing devices and the valves cooperate such that upon at least one of the plurality of fire sensing devices detecting fire in the structure, the fire sensing device signals the central computer system, the central computer system then receiving and analyzing the signals to determine the location of the fire in the structure and command the valves on at least one of the fire suppression fluid pipes associated with the location of the fire to open to release fire suppression fluid therethrough for extinguishing the fire at the electrical outlet, device, appliance and fixture at which it started.

The electrical fire extinguishing system of the present invention thus provides many features which improve fire fighting capabilities in buildings and structures. For example, because the present invention sends fire suppression fluid directly to the ignition location of the fire, fires are extinguished much more quickly than is possible with other fire fighting devices found in the prior art. Furthermore, because the fire suppression fluid is distributed within the electrical outlets, switches and fixtures of the building, damage to room furnishings is greatly reduced without sacrificing fire fighting efficiency. Finally, as there is currently no method or system in place by which a centralized system can distribute fire suppression fluid directly to electrical outlets and fixtures, it would appear that the present invention addresses and solves a long-felt and unsolved need. It is thus seen that the electrical fire extinguishing system of the present invention is superior and unique when compared to those systems and methods found in the prior art.

DESCRIPTION OF THE PREFERRED EMBODIMENT

Figure 1:
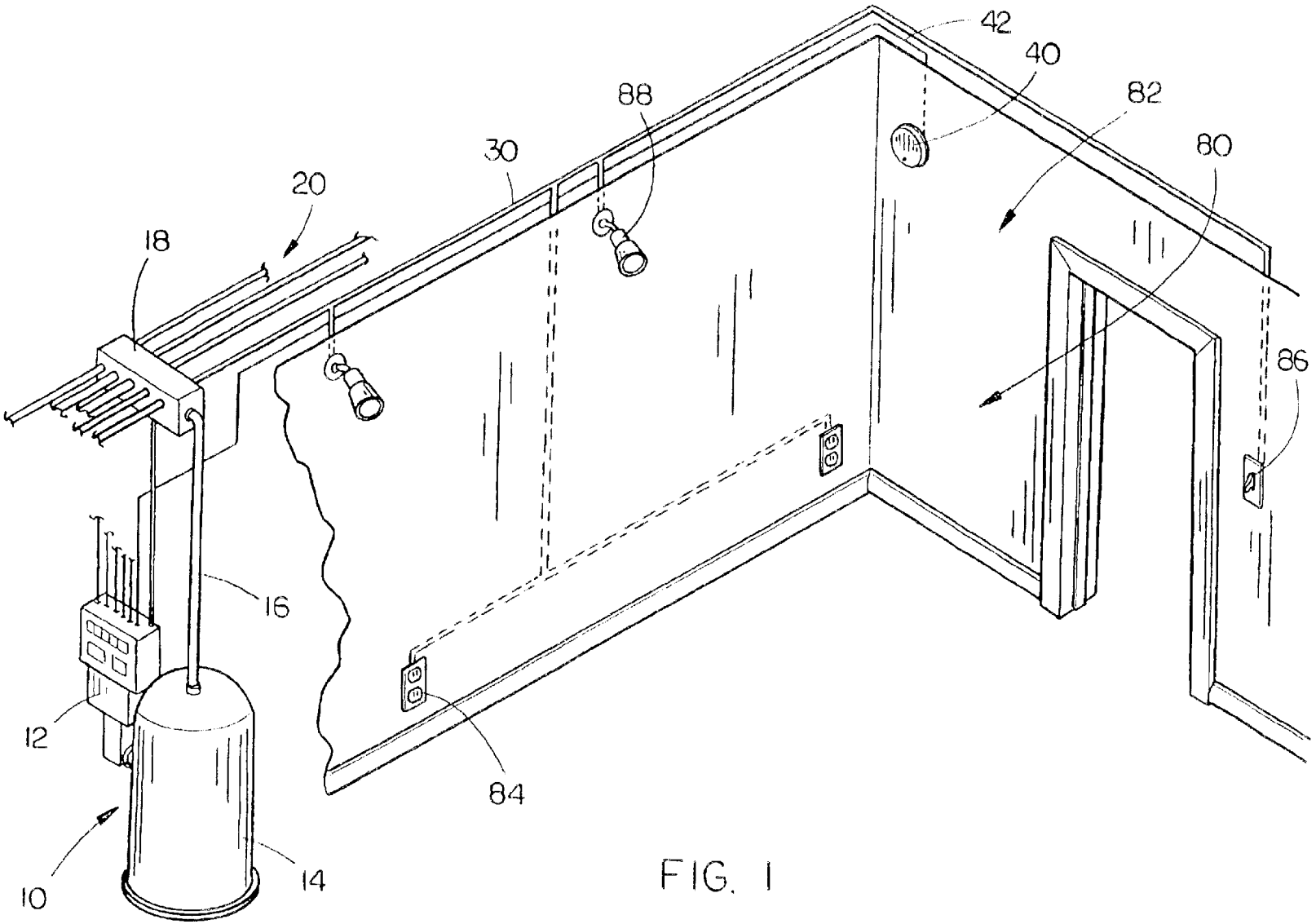
FIG. 1 is a perspective view of the present invention showing the features thereof.
Figure 2:
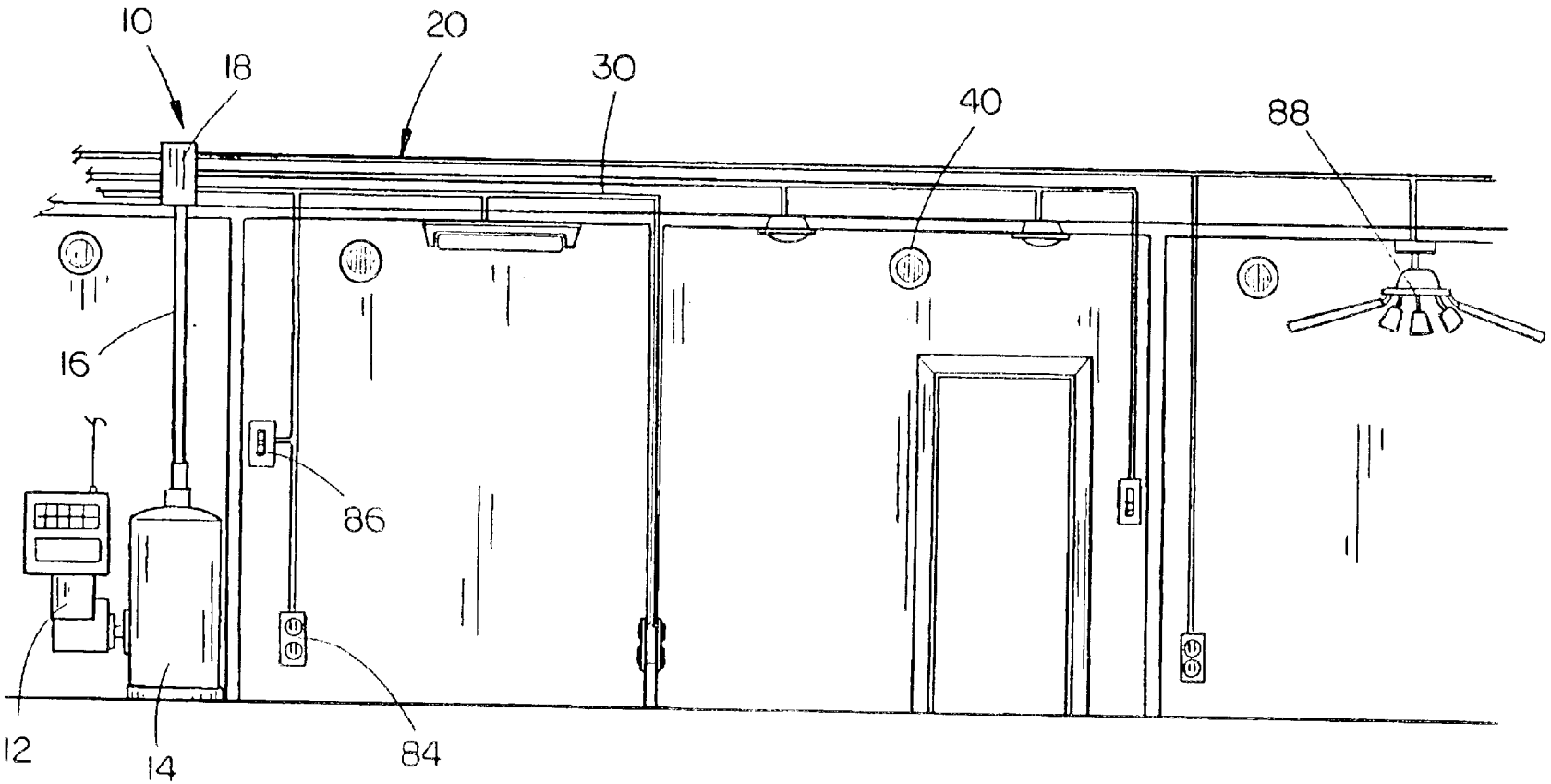
FIG. 2 is a side elevational view of the present invention.
Figure 3:
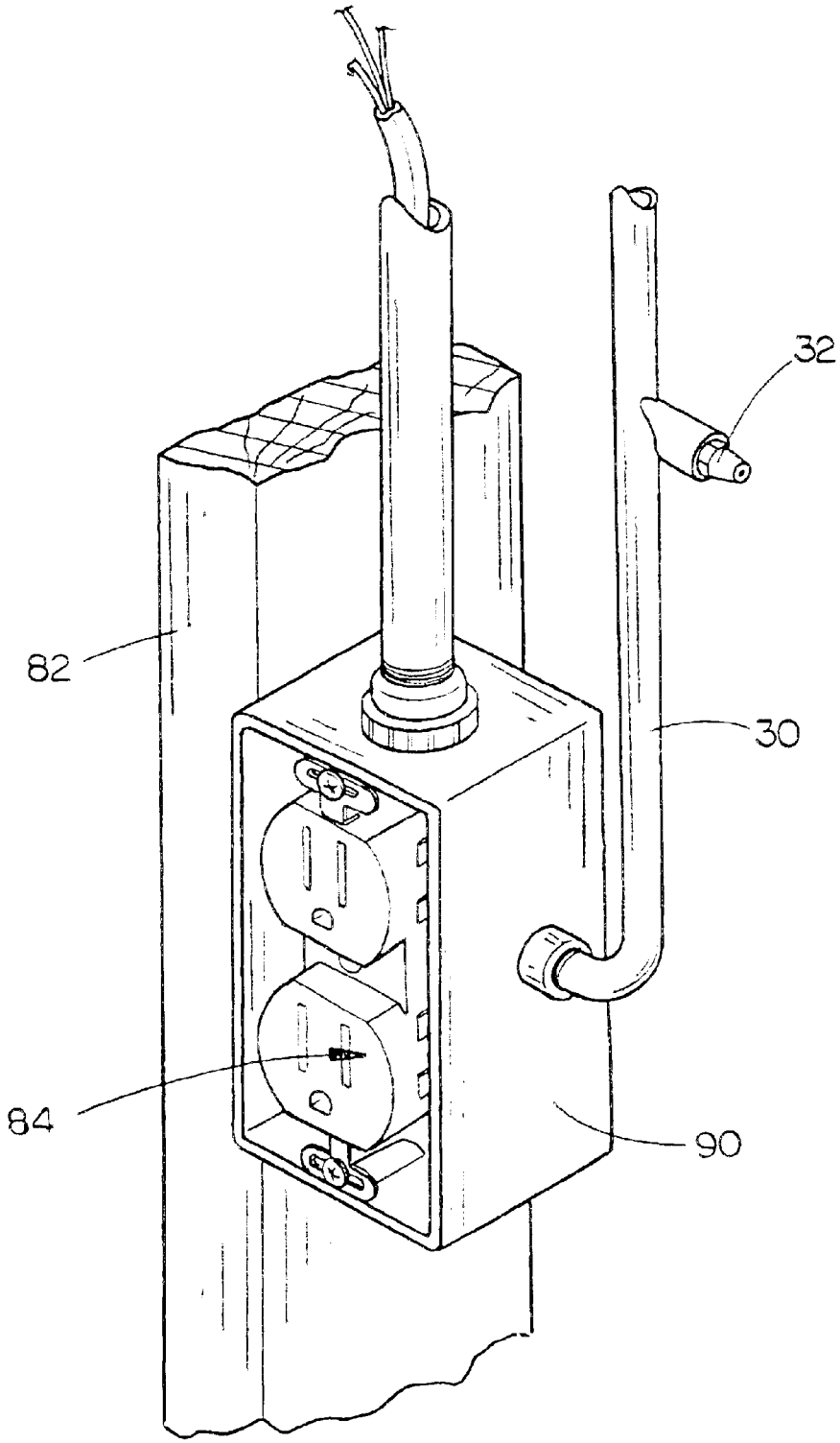
FIG. 3 is a detail perspective view of an electrical outlet to which the present invention is connected.

The electrical fire extinguishing 10 of the present invention is shown best in FIGS. 1–3 as including a central computer system 12 and a central fire suppression fluid tank 14 mounted within the building 80 into which the electrical fire extinguishing system 10 of the present invention is fitted. In the preferred embodiment, the central computer system 12 would include at least one micro processor programmed to command the electrical fire extinguishing system 10 of the present invention and the central fire suppression fluid tank 14 would preferably be a pressurized tank holding a large quantity of a fire suppression fluid such as monoammonia phosphate which is liquid in form. Of course, many other different types of fire suppression fluids and solids may be used with the present invention, such as dry chemicals including sodium or potassium bicarbonate or ammonium phosphate, carbon dioxide in either gas or liquid form or Halotron I, which is a specially designed electrical fire suppression gas, so long as the fluid or solid may be quickly and safely transported via-pipe or conduit to the fire location for suppression and extinguishing thereof. Such fire extinguishing fluids and solids are known in the prior art and would be chosen according to the desires and needs of the user of the present invention. Moreover, it should be noted that although the present description uses the term "fluid" in connection with the fire suppression material distributed via the present invention, any appropriate fire suppression fluid or solid may be used with the present invention so long as it is easily distributed through the piping of the system.

A main fluid conduit 16 extends out of central fire suppression fluid tank 14 and is connected to valve bank 18 as shown best in FIGS. 1 and 2. It is preferred that all of the pipe and conduit used in connection with the present invention be metal or plastic in order to ensure generally maintenance-free operation of the present invention while also having a higher melting point to improve the operational capabilities of the present invention in the event of fire. The valve bank 18 includes a plurality of valves (not shown) which control fluid flow from the main fluid tube 16 outwards through the rest of the building 80 via the fire suppression fluid pipes 20. The fire suppression fluid pipes 20 are referred to collectively for clarification purposes, as they are generally identical to one another. However, discussion of the individual fire suppression fluid pipes 20 will refer to the pipes by a separate reference numeral, as it is preferred that each of the fire suppression fluid pipes 20 extend to a different section of the building 80 for generally complete fire suppression coverage.

As shown best in FIGS. 1 and 2, each of the fire suppression fluid pipes 20 extend into a different section of the building and are connected to the various electrical outlets, switches, and fixtures mounted within the building 80. Specifically, looking at FIG. 1, it is seen that fire suppression fluid pipe 30 extends outwards from valve bank 18 within the wall 82 of building 80 and includes a series of junctions and joints which branch off of fire suppression fluid pipe 30 to connect the pipe to each of the electrical outlets 84, switches 86, and electrical fixtures 88 mounted within the building 80. The construction of the fire suppression fluid pipe 30 would be understood by one skilled in the art of plumbing construction and the installation of the various T-shaped junctions and joints to permit the fire suppression fluid pipe 30 to connect to each of the outlets 84, switches 86, and fixtures 88 would be likewise be understood by those skilled in the plumbing arts. Of course, depending on the pipe construction material used, different joint and junction designs would be implemented, and the precise sizes and shapes of the fire suppression fluid pipes would generally be dictated by the building characteristics and fluid flow requirements.

FIG. 3 illustrates the connection of fire suppression fluid pipe 30 to an electrical outlet 84. As shown, the fire suppression fluid pipe 30 feeds into the metal box 90 of outlet 84 such that fire suppression fluid may flow through fire suppression fluid pipe 30 into the metal box 90, thus flooding the interior of the metal box 90 and extinguishing any fires which have begun within the outlet 84. The connection of the fire suppression fluid pipe 30 to the metal box 90 would preferably include a nozzle of some type to widen the spray of the fire suppression fluid being released from the fire suppression fluid pipe 30, although the inclusion of such a nozzle is not critical to the present invention.

Of course, not every electrical fire begins within the outlet 84. Instead, some fires begin with the wiring inside the walls of the building 80, and it is these fires which are extremely dangerous as there is no outward sign of the fire until the fire has gained strength. For this reason, the present invention proposes the inclusion of additional internal wall nozzles 32 which extend off of the fire suppression fluid pipe 30, as shown best in FIG. 3. The internal wall nozzle 32 would spray fire suppression fluid within the wall 82, thus dampening any fires starting within the walls and doing so in a way which will not damage the interior wall structure, as would occur if water were to be sprayed within the wall structure by a standard-type sprinkler system. The positioning, size and shape of the internal wall nozzle 32 would be determined on a case-by-case basis depending on the wall structure in which the present invention is mounted and the fire fighting capabilities desired by the user of the present invention.

In the preferred embodiment, fire suppression fluid pipes 20 would extend to each and every outlet 84, switch 86, and fixture 88 within the building in the manner shown best in FIG. 3 to substantially prevent the spread of electrical fires by quickly and safely extinguishing the fire at its source. However, in order to properly extinguish these fires, the presence of the fire must be sensed and therefore it is an important element of the present invention to include a plurality of fire sensing devices 40 distributed throughout the building on the walls, ceilings, and in the various electrical fixtures, switches, and outlets throughout the building in order to sense the presence of fire and signal the central computer system 12 that a fire has started. The exact nature of the fire sensing device 40 is not critical to the present invention so long as it is able to detect fire, smoke, or any of the other signs of the presence of fire within the building 80. Therefore, the fire sensing device 40 may be a smoke detector, a heat detector, a spark detector, or any other appropriate fire sensing device 40 which will be usable with the present invention.

The occurrence of fire within the building 80 will cause the electrical fire extinguishing system 10 of the present invention to respond in the following manner. The fire sensing device 40 first senses the presence of fire within the building 80 and sends a signal to the central computer system 12 via electrical cable 42. The central computer system 12 is programmed to receive these signals, identify the location of the fire sensing device 40 sending the signal, and then take steps to eliminate the fire at the source of the fire. The central computer system 12 commands the valve bank 18 to open one or more valves associated with the fire suppression fluid pipes 20 which lead to the endangered area of the building 80 as signaled by the fire sensing device 40. Fire suppression fluid would then flow out of central fire suppression fluid tank 14 through main fluid tube 16 into valve bank 18 where it is directed into the appropriate fire suppression fluid pipe 20, in this instance fire suppression fluid pipe 30, which leads to the endangered section of the building 80. The fire suppression fluid flows through fire suppression fluid pipe 30 into the various outlets 84, switches 86, and fixtures 88 immediately extinguishing any fires which have started within those electrical devices and preventing the spread of the fire. The central computer system 12 may also be programmed to inform the fire department of the presence of the fire and/or inform building security to confirm that the fire has been extinguished and permit the resetting of the central computer system 12 and electrical fire extinguishing system 10 to its activated status in preparation for the next fire within the building 80.

It should be noted that several modifications to the electrical fire extinguishing system 10 of the present invention are contemplated and made a part of this disclosure, specifically that the number of valves, pipes, and junctions may be modified or changed depending upon the layout of the building 80 in which the electrical fire extinguishing system 10 of the present invention is mounted. For example, it may be desirable to include additional valves to control distribution of fire suppression fluid to single fixtures, outlets or switches, depending upon the cost of the system and the specific needs of the end user. Furthermore, it may be preferable to have a plurality of the central fire suppression fluid tanks 14 mounted throughout the building 80, particularly in the case of very large and very tall buildings which increase the difficulty of distribution of fire suppression fluid throughout the building. Also, it should be noted that the present invention is designed to work in conjunction with available sprinkler systems, but because the present invention distributes the fire suppression fluid directly into the electrical devices mounted within the building 80, peripheral damage to office furnishings is greatly reduced and/or eliminated, providing a significant advantage over those fire suppression systems found in the prior art.

It is to be understood that numerous modifications, additions and substitutions may be made to the electrical fire extinguishing system 10 of the present invention which fall within the intended broad scope of the appended claims. For example, the exact size, shape, and construction materials used in connection with the present invention are not critical to the present invention so long as the intended functionality of the invention is neither degraded nor destroyed. Also, the precise connection of the fire suppression fluid pipes 20 to the various outlets 84, switches 86, and fixtures 88 is not critical to the present invention so long as the fire suppression fluid being sent through the fire suppression fluid pipes 20 may quickly and easily access the various outlets 84, switches 86, and fixtures 88 to extinguish fires which have started there within. Furthermore, the precise nature of the central computer system 12 is not critical so long as the functional features of the central computer system 12, namely the interpretation of signals received from the various fire sensing devices 40, the identification of the location of the fire, and signaling of the valve bank 18 to release fire suppression fluid to the fire, are maintained. It should also be noted that although the present invention is disclosed for use in connection with structures, the present invention may be used with boats, particularly cruise ships, and other vehicles such as buses and recreational vehicles. Finally, although the present invention has been described for use in connection with outlets 84, switches 86, and fixtures 88, it should be noted that virtually any type of electrical device which is mounted within the structure, ship, vehicle or building 80 may be connected to the present invention for extinguishing of fires caused by the electrical connections within the device.

There has therefore been shown and described an electrical fire extinguishing system 10 which accomplishes at least all of its intended objectives.

We claim:

1. An electrical fire suppression system for a structure having at least one of an electrical outlet, electrical device, electrical appliance and electrical fixture, said system comprising:

a central computer system;

a plurality of fire sensing devices distributed through the structure in information transmission connection with said central computer system;

a central fire suppression material tank;

a plurality of fire suppression material pipes in material transmission connection with said central fire suppression material tank;

a valve bank including a plurality of valves each operatively mounted on a selected one of said plurality of fire suppression material pipes for controlling fire suppression material flow therethrough, said valve bank controllable by said central computer system;

said central computer system operatively connected to said valve bank and said plurality of valves for opening and closing of said plurality of valves for release of fire suppression material through at least one of said plurality of fire suppression material pipes to a fire location signified by at least one of said plurality of fire sensing devices thereby extinguishing the fire at the fire location;

each of said plurality of fire suppression material pipes extending into the interior volume of at least one of the electrical outlets, devices, appliances and fixtures for transfer of fire suppression material directly into the interior volume of at least one of the electrical outlet, device, appliance and fixture thereby extinguishing electrically-caused fires at the source thereof; and said central computer system, said plurality of fire sensing devices and said valve means cooperating such that upon at least one of said plurality of fire sensing devices detecting fire in the structure, said at least one of said plurality of fire sensing devices signals said central computer system, said central computer system operative to receive and analyze said signals to determine the location of the fire in the structure and command said valve bank and said plurality of valves on at least one of said fire suppression material pipes associated with the location of the fire to open to release fire suppression material therethrough for extinguishing the fire in the interior volume of at least one of the electrical outlet, device, appliance and fixture at which it started.

2. The electrical fire suppression system of claim 1 wherein said plurality of fire sensing devices are each operative to detect the local presence of at least one of a fire, smoke, electrical spark and increased heat.

3. The electrical fire suppression system of claim 1 wherein said central fire suppression material tank comprises a pressurized tank containing fire suppression fluid stored under pressure.

4. The electrical fire suppression system of claim 1 wherein the fire suppression material is selected from the group comprising monoammonia phosphate, sodium bicarbonate, potassium bicarbonate, carbon dioxide in gas form, carbon dioxide in liquid form and Halotron I fire suppression gas.

* * * * *